US011851839B1

(12) United States Patent
Fuller

(10) Patent No.: US 11,851,839 B1
(45) Date of Patent: Dec. 26, 2023

(54) CASED PILES

(71) Applicant: Andrew Corbin Fuller, Ridgeville, SC (US)

(72) Inventor: Andrew Corbin Fuller, Ridgeville, SC (US)

( * ) Notice: Subject to any disclaimer, the term of this patent is extended or adjusted under 35 U.S.C. 154(b) by 0 days.

(21) Appl. No.: 17/543,718

(22) Filed: Dec. 6, 2021

(51) Int. Cl.

| | |
|---|---|
| ***E02D 5/38*** | (2006.01) |
| ***E02D 5/24*** | (2006.01) |
| ***E02D 5/56*** | (2006.01) |
| ***E02D 5/22*** | (2006.01) |

(52) U.S. Cl.
CPC ..... *E02D 5/223* (2013.01); *E02D 5/24* (2013.01); *E02D 5/38* (2013.01); *E02D 5/56* (2013.01)

(58) Field of Classification Search
CPC .. E02D 5/24; E02D 5/223; E02D 5/34; E02D 5/38; E02D 5/56; E02D 7/22; E02D 7/28
See application file for complete search history.

(56) References Cited

U.S. PATENT DOCUMENTS

| | | | | |
|---|---|---|---|---|
| 2,983,345 A | | 5/1961 | Anger | |
| 3,645,055 A | | 2/1972 | Roza | |
| 3,680,274 A | | 8/1972 | Deike | |
| 4,650,372 A | | 3/1987 | Gorrell | |
| 5,066,168 A | * | 11/1991 | Holdeman | E02D 7/22 405/245 |
| 5,575,122 A | | 11/1996 | Hamilton | |
| 5,707,180 A | | 1/1998 | Vickars et al. | |
| 6,058,662 A | | 5/2000 | Perko | |
| 6,264,402 B1 | * | 7/2001 | Vickars | E02D 5/46 405/251 |
| 6,368,021 B1 | | 4/2002 | Strong et al. | |
| 6,652,195 B2 | | 11/2003 | Vickars et al. | |
| 6,722,821 B1 | * | 4/2004 | Perko | E02D 5/801 405/249 |
| 6,814,525 B1 | * | 11/2004 | Whitsett | E02D 5/38 405/253 |
| 7,314,335 B2 | * | 1/2008 | Whitsett | E02D 5/38 405/253 |
| 7,416,367 B2 | * | 8/2008 | St. Onge | E02D 5/80 405/230 |
| 7,494,299 B1 | * | 2/2009 | Whitsett | E02D 5/38 405/254 |

(Continued)

FOREIGN PATENT DOCUMENTS

| | | |
|---|---|---|
| GB | 2418949 A | 4/2006 |
| JP | 1-244015 A | 9/1989 |

OTHER PUBLICATIONS

Machine Translation of Japanese Patent Application No. 1-244015 (18 pages).

*Primary Examiner* — Frederick L Lagman
(74) *Attorney, Agent, or Firm* — Thrive IP®; Jeremy M. Stipkala

(57) ABSTRACT

A pile for stabilizing soil for building a structure thereon includes a casing having an upper end opposite a lower end, a shaft positioned inside the casing, the shaft having a first end proximal to the upper end of the casing and a second end proximal to the lower end of the casing, wherein the casing and the shaft are substantially coaxial; and a plate attached proximal to the upper end of the casing and holding the shaft inside the casing. Optionally, the plate has one or more grout holes to allow liquid grout to flow into the casing along the shaft, potentially increasing the stability of the pile in soil.

20 Claims, 4 Drawing Sheets

(56) References Cited

U.S. PATENT DOCUMENTS

| | | | | |
|---|---|---|---|---|
| 7,546,887 | B2 | 6/2009 | Schwab | |
| 7,854,451 | B2 * | 12/2010 | Davis, II | F16L 25/08 405/252.1 |
| 8,033,757 | B2 | 10/2011 | Stroyer | |
| 8,506,207 | B2 | 8/2013 | Lutenegger et al. | |
| 8,613,571 | B1 * | 12/2013 | Watson, III | E02D 5/34 405/252.1 |
| 8,926,228 | B2 | 1/2015 | Stroyer | |
| 9,051,706 | B1 | 6/2015 | Ludwig | |
| 9,181,674 | B2 * | 11/2015 | El Naggar | E02D 5/36 |
| 9,631,335 | B2 | 4/2017 | Reusing et al. | |
| 10,024,020 | B2 | 7/2018 | Fuller | |
| 10,392,768 | B2 * | 8/2019 | Kemp | E02D 7/22 |
| 2003/0159839 | A1 | 8/2003 | Perko | |
| 2006/0051183 | A1 | 3/2006 | Powell | |
| 2012/0037261 | A1 | 2/2012 | Nagata | |
| 2012/0114425 | A1 | 5/2012 | Seider et al. | |
| 2015/0117960 | A1 | 4/2015 | Kemp et al. | |
| 2015/0233075 | A1 | 8/2015 | Maggio | |
| 2015/0345098 | A1 | 12/2015 | Song | |
| 2016/0251819 | A1 | 9/2016 | Dinh | |
| 2017/0198453 | A1 | 7/2017 | Brown | |
| 2018/0155893 | A1 | 6/2018 | Fuller | |
| 2018/0258602 | A1 | 9/2018 | Kemp | |
| 2019/0324007 | A1 | 10/2019 | Dugard | |

* cited by examiner

© 2021 Andrew C. Fuller

© 2021 Andrew C. Fuller

© 2021 Andrew C. Fuller

Fig. 6
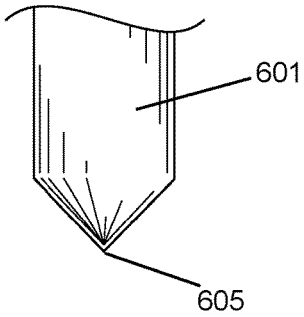
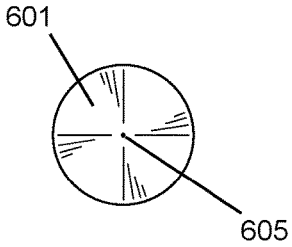
Fig. 7
Fig. 8
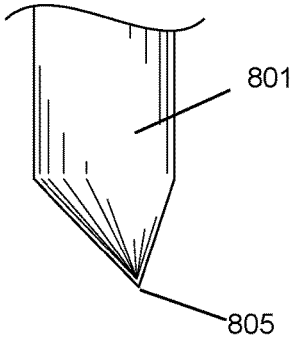
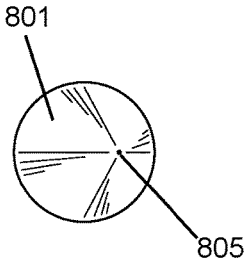
Fig. 9
Fig. 10
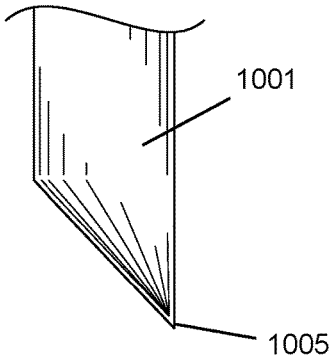
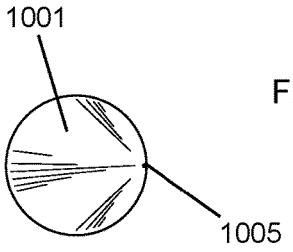
Fig. 11
© 2021 Andrew C. Fuller

CASED PILES

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to soil stabilization for the construction of roads, buildings, and other structures.

BACKGROUND OF THE INVENTION

Building a structure anchored on solid bedrock affords great support for the structure. However, many areas of desirable real estate do not have accessible bedrock. In some cases, suitable bedrock lies too far beneath the soil. In other cases, the nature of the soil requires stabilization measures in addition to or instead of merely resting a foundation on bedrock. In still other cases, stabilizing soil adjacent to a structure makes sense, allowing the stabilized adjacent soil to laterally support the structure by preventing subsidence.

Construction piles are known. Also, pouring liquid grout around piles driven into the ground are known. Soil collapsing around a pile freshly driven into the soil may make it difficult for liquid grout to completely and evenly flow to the lowest reaches of the pile, however, diminishing the contribution of the hardened grout. When a pile is driven into the ground, the soil around the pile exerts lateral forces against the pile. Conversely, the driven pile compresses the soil laterally. Against these lateral forces, it is beneficial to add a sheath of solidified grout to support the pile, and to some extent, maintain the soil in a compressed state. To add supporting grout, the grout needs to be formed around the pile before the pile is driven into the ground, or the grout needs to be added once the pile is in the ground, according to current technology. Neither of those current solutions fully satisfy, because driving a pile encased in hardened grout practically requires a pre-excavated channel for the encased pile. In addition, the encased pile will have a mass much greater than the pile itself, requiring heavy machinery to manipulate it. The alternative of pouring liquid grout fails to optimize the domains of solidified grout around the pile. Improvements in construction pile technology are needed.

SUMMARY OF THE INVENTION

Accordingly, Applicant surprising has invented certain piles for stabilizing soil useful in construction. One such pile includes a casing having an upper end opposite a lower end, a shaft positioned inside the casing, the shaft having a first end proximal to the upper end of the casing and a second end proximal to the lower end of the casing, wherein the casing and the shaft are substantially coaxial; and a plate attached proximal to the upper end of the casing and holding the shaft inside the casing. Optionally, the plate has one or more grout holes to allow liquid grout to flow into the casing along the shaft, potentially increasing the stability of the pile in soil.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

BRIEF DESCRIPTION OF THE DRAWINGS

FIGS. 6 and 7 illustrate a second end 601 of a shaft terminating in a point 605 that is a coaxial point.

FIGS. 8 and 9 illustrate a second end 801 of another shaft terminating in a point 805 that is an offset point.

FIGS. 10 and 11 illustrate a second end 1001 of still another shaft terminating in a point 1005 that is an edge point.

DETAILED DESCRIPTION

Figure 1:
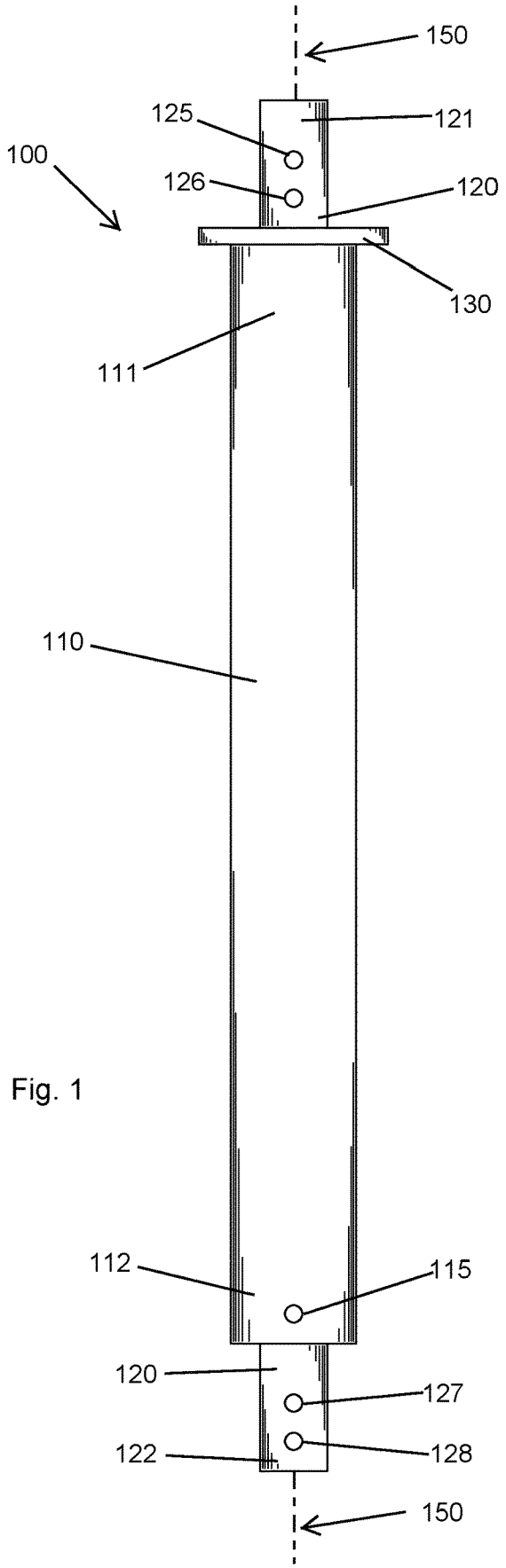
FIGS. 1-3 depict one embodiment of the invention comprising pile 100.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this disclosure prevail unless stated otherwise.

Wherever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

Accordingly, some embodiments of the present invention provide piles for stabilizing soil for building a structure thereon, one such pile comprising a casing having an upper end opposite a lower end; a shaft positioned inside the casing, the shaft having a first end proximal to the upper end of the casing and a second end proximal to the lower end of the casing, wherein the casing and the shaft are substantially coaxial; and a plate attached proximal to the upper end of the casing and holding the shaft inside the casing. As can be appreciated, the plate can be substituted by any suitable structure adequate for bracing the shaft inside the casing. In addition, such structure may allow for the flow of liquid grout into the casing. In some cases, the flow of grout into the casing is allowed by one or more grout holes adapted to allow liquid grout to flow into the casing around the shaft.

The piles of the present invention and the parts thereof can have any suitable dimensions. For example, in some cases, the first end of the shaft extends outside of the casing beyond the plate and the upper end. In further cases, the second end of the shaft can extend outside of the casing beyond the lower end. In further cases, the shaft is at least about 4 feet long, at least about 5 feet long, at least about 6 feet long, at least about 7 feet long, at least about 8 feet long, at least about 9 feet long, at least about 10 feet long, at least about 15 feet long, or at least about 20 feet long. Additional cases provide a shaft that is no more than about 5 feet long, no more than about 6 feet long, no more than about 7 feet long, no more than about 8 feet long, no more than about 9 feet long, no more than about 10 feet long, no more than about 15 feet long, no more than about 20 feet long, or no more than about 30 feet long. Similarly, the casing can have any suitable dimensions. In certain instances of the present invention, the casing has a diameter that is at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, or at least about 20 inches. Further instances provide the casing having a diameter that is no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, no more than about 20 inches, or no more than about 30 inches.

Piles of the present invention can include any suitable structure and geometry. For example, the shaft may include one or more shaft bolt holes adapted to connect the pile to other equipment. In another example, the casing comprises one or more casing bolt holes adapted to connect the pile to other equipment. Such additional structure may also assist with the penetration of soil. In some cases, the shaft includes one or more helixes proximal to the second end and beyond the lower end of the casing. The second end of the shaft may be specially designed to penetrate soil. Soil penetration can be facilitated, for instance, by terminating the second end of the shaft in one or more points. The point or points may be chosen from any suitable geometry, such as, for example, a coaxial point, an offset point, and an edge point. A coaxial point appears on the geometric center of the second end of the shaft, in those cases where the second end is adapted to penetrate soil. An edge point appears at the circumference of the shaft, in some cases as if the shaft were a cylinder that was cut at a diagonal. An offset point appears between the edge and the geometric center. The precession of the edge point or the offset point helps break up and divert soil as the pile is rotated.

The piles of the present invention may have a shaft, casing, and plate independently exhibiting cross-sections of any desired geometry. For example, the shaft may exhibit a cross-section chosen from circular, triangular, square, rectangular, pentagonal, hexagonal, heptagonal, and octagonal. Independently of the shaft, the casing may have a cross-section chosen from circular, triangular, square, rectangular, pentagonal, hexagonal, heptagonal, and octagonal. Independent of the geometries of other portions of the pile, the plate may have a shape chosen from circular, triangular, square, pentagonal, hexagonal, heptagonal, and octagonal.

The piles of the present invention can be manufactured with any suitable materials. In certain instances, a pile is made from steel. Any suitable steel can be used. Stainless steels, carbon steels, and the like may be mentioned. The steel components can be welded together, molded as one, or otherwise attached in any suitable manner. The piles can exhibit any suitable properties and performance. In some cases, the casing has a minimum tensile strength of about 50 ksi and a minimum yield strength of about 40 ksi. In further instances, the shaft has a minimum tensile strength of about 50 ksi and a minimum yield strength of about 40 ksi.

Piles of the present invention can be manufactured in any suitable manner. In some cases, making a pile involves welding the plate perpendicular to the shaft proximal to the first end of the shaft; positioning the shaft inside the casing so that the casing and the shaft are substantially coaxial and the plate is proximal to the upper end of the casing; and welding the plate to the casing. The order of those steps is not critical. The plate could be welded to the shaft first, or welded to the casing first. Optionally, various holes, for bolts, for grout, or for either or for another purpose can be drilled before or after welding components together.

Optionally, a pile of the present invention can be manufactured with hardened grout partly or completely filling the space between the casing and the shaft. Or, grout can be added to the pile after manufacturing but before deploying the pile in soil.

Several methods of stabilizing soil using the piles described herein may be mentioned. Certain of those methods involve driving the pile into the soil. Driving the pile can include any suitable efforts. In some cases, the pile is pounded, screwed, or pressed into soil, or a combination of such efforts are employed. Optionally, the soil where the pile will go can be opened with an auger and a quantity of soil removed, creating a void in the soil for the pile to enter. Such void can represent substantially the entire volume the pile, or only a portion of that volume. In certain cases, however, no soil is removed, but rather the driving of the pile compresses the soil around the pile, and the compressed soil aids its stabilization. In a further step, liquid grout can be added to the pile as it has been positioned in the soil, for example, by injecting liquid grout into one or more holes in the plate so the liquid grout flows into the casing.

Any suitable liquid grout can be used. Very large rocks in the liquid grout are discouraged, as they could lodge in the holes and hinder the flow of liquid grout into the casing. Otherwise, concretes such as are known in the art using a suitable cement such as those known as Portland cement can be used as liquid grout, for example. Polymeric grouts may be used in some applications. It is desired that the liquid grout flows along the pile to form solid domains of grout supporting the pile. In some cases, the solid grout forms a solid case of concrete around the pile when installation is complete and the grout has fully cured. In other cases, pouring the liquid grout might not lead to a perfect encasement of the pile by the solidified grout.

As used herein, "soil" indicates any solid material found on Earth with the exception of monolithic rock. Soils may include mud, silt, sand, clay, pebbles, compacted forms of any of those, and combinations thereof. Placing the piles of the present invention in monolithic rock such as bedrock may require pre-formed channels in the rock formed by suitable methods such as those known in the art.

The structures that can be built on the soils stabilized with the piles described herein are not limited. Roads, sidewalks, runways, parking lots, bridge footings, docks, boardwalks, swimming pools, storage tanks, chemical processing equipment such as refineries, windmills, and oil drilling platforms including those deployed at sea, may be mentioned. Foundations for buildings, and the buildings themselves, such as homes, warehouses, factories, office buildings, and the like may be mentioned. Further, at least some of the piles of the present invention can be used to stabilize soil when the only purpose is to stabilize the soil. It may be beneficial to have the soil adjacent a structure be stabilized in the event of flooding or earthquake, and that can be accomplished with piles of the present invention.

DETAILED DESCRIPTION OF THE DRAWINGS

Further embodiments of the present invention can be described by reference to the accompanying drawings.

Figure 2:
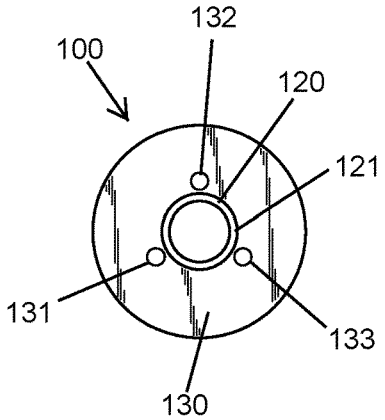
Figure 3:
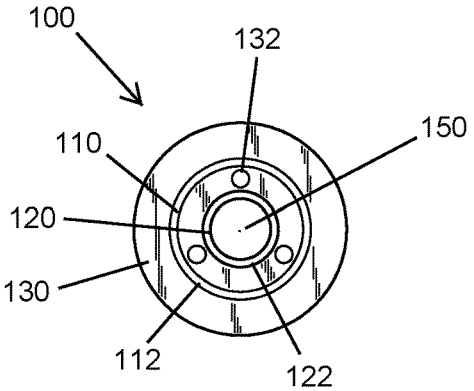

FIGS. 1-3 depict one embodiment of the invention comprising pile 100. FIG. 1 shows a side elevation view; FIG. 2 provides a top plan view, and FIG. 3 shows a bottom plan view. Pile 100, suitable for stabilizing soil for building a structure thereon, includes casing 110 having upper end 111 opposite lower end 112. Shaft 120 is positioned inside casing 110, shaft 120 having a first end 121 proximal to upper end 111 of casing 110, and second end 122 proximal to lower end 112 of casing 110. Casing 110 and shaft 120 are substantially coaxial with each other, as indicated by axis 150. Plate 130 is attached proximal to upper end 111 of casing 110, and holds shaft 120 inside casing 110.

Plate 130 includes grout holes 131, 132, 133 adapted to allow liquid grout to flow into casing 110 around shaft 120. First end 121 of shaft 120 extends outside casing 110 beyond plate 130 and upper end 111. Second end 122 extends outside of casing 110 beyond the lower end 112. Shaft 120 includes shaft bolt holes 125, 126, 127, 128, adapted to connect pile 100 to other equipment (not shown). Such other equipment includes, but is not limited to, suitable extension sections, lead sections, and bits, such as are described in U.S. Pat. No. 10,024,020 B2. U.S. Pat. No. 10,024,020 B2 is incorporated herein by reference in its entirety. Casing bolt hole 115 is adapted to connect pile 100 to other equipment as well.

Before or after pile 100 is driven into soil, liquid grout can be poured into grout holes 131, 132, 133 so that liquid grout flows into casing 110 along shaft 120. Once the grout hardens, the grout strengthens pile 100 by supporting casing 110, according to one possible mechanism. In some cases, liquid grout may flow beyond lower end 112, adding further support below pile 100 once the liquid grout cures.

Figure 4:
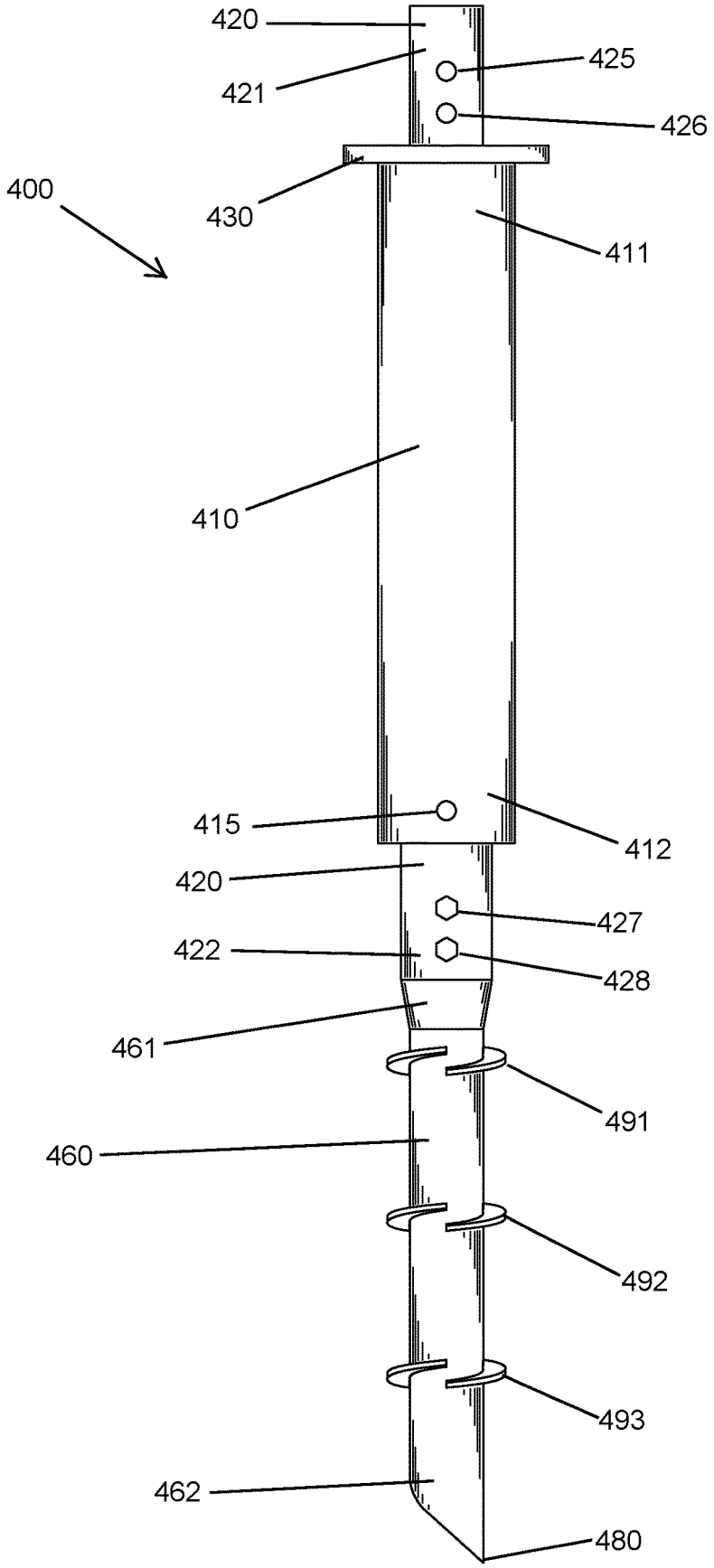
FIG. 4 depicts another embodiment comprising pile 400 attached to lead section 460.

FIG. 4 depicts another embodiment comprising pile 400 attached to lead section 460. Pile 400, suitable for stabilizing soil for building a structure thereon, includes casing 410 having upper end 411 opposite lower end 412. Shaft 420 is positioned inside casing 410, shaft 420 having a first end 421 proximal to upper end 411 of casing 410, and second end 422 proximal to lower end 412 of casing 410. Casing 410 and shaft 420 are substantially coaxial with each other. Plate 430 is attached proximal to upper end 411 of casing 410, and holds shaft 420 inside casing 410. Plate 430 includes grout holes (not seen) adapted to allow liquid grout to flow into casing 410 around shaft 420. Shaft 420 includes shaft bolt holes 425, 426, adapted to connect pile 100 to other equipment. Such other equipment includes, for example, lead section 460, which has top-end 461 opposite bottom end 462. Bolts 427, 428 connect second end 422 of shaft 420 to top end 461 of lead section 460. Proximal to bottom end 462 are positioned helixes 491, 492, 493, 494 on lead section 460, which assist driving pile 400 into soil when pile 400 is rotated. Bottom end 462 is adapted to penetrate soil by terminating in point 480.

Figure 5:
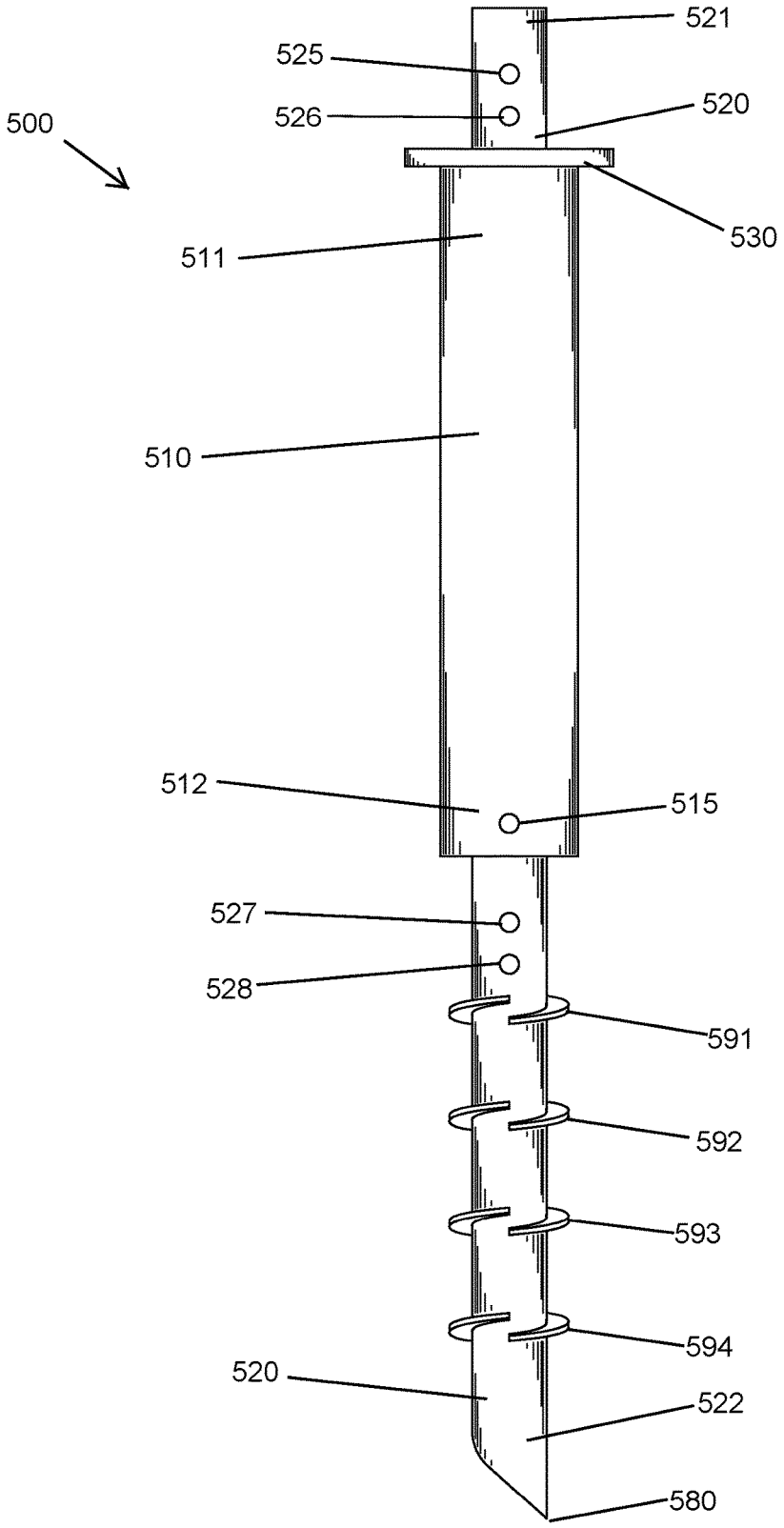
FIG. 5 depicts still another embodiment comprising pile 500.

FIG. 5 depicts still another embodiment comprising pile 500. Pile 500, suitable for stabilizing soil for building a structure thereon, includes casing 510 having upper end 511 opposite lower end 512. Shaft 520 is positioned inside casing 510, shaft 520 having a first end 521 proximal to upper end 511 of casing 510, and second end 522 proximal to lower end 512 of casing 510. Casing 510 and shaft 20 are substantially coaxial with each other. Plate 530 is attached proximal to upper end 511 of casing 510, and holds shaft 520 inside casing 510.

Plate 530 includes grout holes (not seen) adapted to allow liquid grout to flow into casing 510 around shaft 520. First end 521 of shaft 520 extends outside casing 510 beyond plate 530 and upper end 511. Second end 522 extends outside of casing 510 beyond the lower end 512. Shaft 520 includes shaft bolt holes 525, 526, 527, 528, adapted to connect pile 500 to other equipment (not shown). Casing bolt hole 515 is adapted to connect pile 500 to other equipment as well. Proximal to second end 522 and beyond lower end 512 of casing 510 are positioned helixes 591, 592, 593, 594 on shaft 520, which assist driving pile 500 into soil when pile 500 is rotated. Second end 522 is adapted to penetrate soil by terminating in point 580.

FIGS. 6 and 7 illustrate a second end 601 of a shaft (not shown in its entirety) terminating in a point 605 that is a coaxial point. FIG. 6 is a front elevation view, and FIG. 7 is a bottom plan view. FIGS. 8 and 9 illustrate a second end 801 of another shaft (not shown) terminating in a point 805 that is an offset point. FIG. 8 is a front elevation view, and FIG. 9 is a bottom plan view. FIGS. 10 and 11 illustrate a second end 1001 of yet another shaft (not shown) terminating in a point 1005 that is an edge point. FIG. 10 is a front elevation view, and FIG. 11 is a bottom plan view.

Clauses

Further understanding of the invention can be obtained from the following clauses.

Clause 1. A pile for stabilizing soil for building a structure thereon, comprising:

a casing having an upper end opposite a lower end;

a shaft positioned inside the casing, the shaft having a first end proximal to the upper end of the casing and a second end proximal to the lower end of the casing, wherein the casing and the shaft are substantially coaxial; and a plate attached proximal to the upper end of the casing and holding the shaft inside the casing.

Clause 2. The pile of clause 1, wherein the plate comprises one or more grout holes adapted to allow liquid grout to flow into the casing around the shaft.

Clause 3. The pile of any one of the preceding clauses, wherein the first end of the shaft extends outside of the casing beyond the plate and the upper end.

Clause 4. The pile of any one of the preceding clauses, wherein the second end of the shaft extends outside of the casing beyond the lower end.

Clause 5. The pile of any one of the preceding clauses, wherein the shaft comprises one or more shaft bolt holes adapted to connect the pile to other equipment.

Clause 6. The pile of any one of the preceding clauses, wherein the casing comprises one or more casing bolt holes adapted to connect the pile to other equipment.

Clause 7. The pile of any one of the preceding clauses, wherein the shaft comprises one or more helixes proximal to the second end and beyond the lower end of the casing.

Clause 8. The pile of any one of the preceding clauses, wherein the second end of the shaft is adapted to penetrate soil.

Clause 9. The pile of clause 8, wherein the second end of the shaft is adapted to penetrate soil by terminating in a point.

Clause 10. The pile of clause 9, wherein the point is chosen from a coaxial point, an offset point, and an edge point.

Clause 11. The pile of any one of the preceding clauses, wherein the casing comprises hardened grout.

Clause 12. The pile of any one of the preceding clauses, wherein the shaft has a cross-section chosen from circular, triangular, square, rectangular, pentagonal, hexagonal, heptagonal, and octagonal.

Clause 13. The pile of any one of the preceding clauses, wherein the casing has a cross-section chosen from circular, triangular, square, rectangular, pentagonal, hexagonal, heptagonal, and octagonal.

Clause 14. The pile of any one of the preceding clauses, wherein the plate has a shape chosen from circular, triangular, square, pentagonal, hexagonal, heptagonal, and octagonal.

Clause 15. The pile of any one of the preceding clauses, comprising steel.

Clause 16. The pile of any one of the preceding clauses, wherein the casing has a minimum tensile strength of about 50 ksi and a minimum yield strength of about 40 ksi.

Clause 17. The pile of any one of the preceding clauses, wherein the shaft has a minimum tensile strength of about 50 ksi and a minimum yield strength of about 40 ksi.

Clause 18. The pile of any one of the preceding clauses, wherein the shaft is at least about 3 feet long, at least about 4 feet long, at least about 5 feet long, at least about 6 feet long, at least about 7 feet long, at least about 8 feet long, at least about 9 feet long, at least about 10 feet long, at least about 15 feet long, or at least about 20 feet long.

Clause 19. The pile of any one of the preceding clauses, wherein the shaft is no more than about 5 feet long, no more than about 6 feet long, no more than about 7 feet long, no more than about 8 feet long, no more than about 9 feet long, no more than about 10 feet long, no more than about 15 feet long, no more than about 20 feet long, or no more than about 30 feet long.

Clause 20. The pile of any one of the preceding clauses, wherein the casing has a diameter that is at least about 4 inches, at least about 5 inches, at least about 6 inches, at least about 7 inches, at least about 8 inches, at least about 9 inches, at least about 10 inches, at least about 11 inches, at least about 12 inches, at least about 15 inches, or at least about 20 inches.

Clause 21. The pile of any one of the preceding clauses wherein the casing has a diameter that is no more than about 5 inches, no more than about 6 inches, no more than about 7 inches, no more than about 8 inches, no more than about 9 inches, no more than about 10 inches, no more than about 11 inches, no more than about 12 inches, no more than about 15 inches, no more than about 20 inches, or no more than about 30 inches.

Clause 22. A method of manufacturing the pile of any one of the preceding clauses comprising:

welding the plate perpendicular to the shaft proximal to the first end of the shaft;

positioning the shaft inside the casing so that the casing and the shaft are substantially coaxial and the plate is proximal to the upper end of the casing; and welding the plate to the casing.

Clause 23. A method of stabilizing soil using the pile of any one of clauses 1-21, comprising:

driving the pile into the soil.

Clause 24. The method of clause 23, further comprising adding liquid grout to the pile inside the casing between the casing and the shaft, and allowing the liquid grout to harden.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A pile for stabilizing soil for building a structure thereon, comprising:

a casing having an upper end opposite a lower end;

a shaft positioned inside the casing, the shaft having a first end proximal to the upper end of the casing and a second end proximal to the lower end of the casing, wherein the casing and the shaft are substantially coaxial; and a plate welded proximal to the upper end of the casing and welded to the shaft, holding the shaft inside the casing;

wherein the lower end of the casing defines a substantially coaxial opening about the shaft proximal to the second end of the shaft; and wherein the first end of the shaft extends outside of the casing beyond the plate and the upper end.

2. The pile of claim 1, wherein the plate comprises one or more grout holes adapted to allow liquid grout to flow into the casing around the shaft.

3. The pile of claim 1, wherein the second end of the shaft extends outside of the casing beyond the lower end.

4. The pile of claim 1, wherein the shaft comprises one or more shaft bolt holes adapted to connect the pile to other equipment.

5. The pile of claim 1, wherein the casing comprises one or more casing bolt holes adapted to connect the pile to other equipment.

6. The pile of claim 1, wherein the shaft comprises one or more helixes proximal to the second end and beyond the lower end of the casing.

7. The pile of claim 1, wherein the second end of the shaft is adapted to penetrate soil.

8. The pile of claim 7, wherein the second end of the shaft is adapted to penetrate soil by terminating in a point.

9. The pile of claim 8, wherein the point is chosen from a coaxial point, an offset point, and an edge point.

10. The pile of claim 1, wherein the casing comprises hardened grout.

11. The pile of claim 1, wherein the shaft has a circular cross-section.

12. The pile of claim 1, wherein the casing has a circular cross-section.

13. The pile of claim 1, wherein the plate has a circular shape.

14. The pile of claim 1, comprising steel.

15. The pile of claim 1, wherein the casing has a minimum tensile strength of about 50 ksi and a minimum yield strength of about 40 ksi.

16. The pile of claim 1, wherein the shaft has a minimum tensile strength of about 50 ksi and a minimum yield strength of about 40 ksi.

17. The pile of claim 1, wherein the shaft is at least about 3 feet long.

18. The pile of claim 1, wherein the shaft is no more than about 8 feet long.

19. The pile of claim 1, wherein the casing has a diameter that is at least about 4 inches.

20. The pile of claim 1 wherein the casing has a diameter that is no more than about 10 inches.

* * * * *